United States Patent [19]

McKay

[11] Patent Number: 4,794,902

[45] Date of Patent: Jan. 3, 1989

[54] METERING OF FUEL

[75] Inventor: Michael L. McKay, Willetton, Australia

[73] Assignee: Orbital Engine Company Proprietary Limited, Balcatta, Australia

[21] Appl. No.: 83,790

[22] PCT Filed: Oct. 10, 1986

[86] PCT No.: PCT/AU86/00301

§ 371 Date: May 18, 1987

§ 102(e) Date: May 18, 1987

[87] PCT Pub. No.: WO87/02419

PCT Pub. Date: Apr. 23, 1987

[30] Foreign Application Priority Data

Oct. 11, 1985 [AU] Australia ..... PH2876
Nov. 11, 1985 [AU] Australia ..... PH3343

[51] Int. Cl.[4] ..... F02M 23/04; F02M 67/02

[52] U.S. Cl. ..... 123/533; 123/459; 123/531

[58] Field of Search ..... 123/531, 532, 533, 534, 123/457, 459

[56] References Cited

U.S. PATENT DOCUMENTS

| | | | |
|---|---|---|---|
| 1,208,686 | 12/1916 | Steinbecker | 123/531 |
| 1,627,727 | 5/1927 | Charter | 123/531 |
| 3,996,906 | 12/1976 | Bubniak et al. | 123/531 |
| 4,167,921 | 9/1979 | Steinwart | 123/531 X |
| 4,394,963 | 7/1983 | Iwata | 123/531 X |
| 4,543,935 | 10/1985 | Tuckey | 123/459 X |
| 4,545,354 | 10/1985 | Jäggle et al. | 123/531 X |

*Primary Examiner*—Willis R. Wolfe

*Attorney, Agent, or Firm*—Armstrong, Nikaido, Marmelstein & Kubovcik

[57] ABSTRACT

Method and apparatus for metering and injecting fuel to an internal combustion engine, particularly suited to in-cylinder injection. Fuel and compressed gas are supplied separately to a valved port (71), with the valve (72) shutting off fuel passages (68) and air passages (66) or allowing fuel and gas to pass through the port (71) and be expelled as a mixture of fuel entrained in the gas. The pressure differential between the fuel and gas at the annular cavity (91) is regulated to control the amount of fuel injected. The position of introduction of the fuel to the gas at the port (71) may be controlled to vary the geometry of the fuel distribution in the resultant spray.

39 Claims, 3 Drawing Sheets

METERING OF FUEL

This invention relates to the metering of fuel to an engine particularly in applications where the fuel is injected directly into the combustion chamber of an engine.

There has previously been proposed methods of metering fuel wherein the metered quantity of fuel is displaced from a variable capacity chamber by a charge of gas, such as air, at an appropriate pressure. It is considered that the charge of gas contributes significantly to the efficient combustion of the fuel, at least in part because of improved atomisation of the fuel.

There has been proposed in our International patent application No. PCT/AU85/00176 and U.S. patent application No. 849501 derived therefrom, still pending an improved method of metering fuel to an engine wherein a continuous supply of fuel under pressure is provided to a closed fixed capacity chamber having a selectively openable delivery port. Gas is periodically admitted to the chamber to maintain in the chamber a pressure not greater than the fuel pressure and the delivery port is opened during the period of admission of gas to the chamber, whereby the fuel in the chamber at the time of opening the delivery port, and fuel that enters the chamber during that period is delivered from the delivery port to the engine. This method of metering and delivering fuel is effective, but presents some difficulties in manufacture, particularly high volume commercial manufacture, partly due to the need for substantially simultaneous operation of the valves controlling the discharge port and the supply of gas to the chamber.

It is the object of the present invention to provide an improved method and apparatus for delivering a metered quantity of fuel to an engine that is effective and accurate in operation, convenient to manufacture and maintain, and assists in promoting a high degree of atomisation of the fuel.

With this object in view there is provided a method of metering fuel to an engine having a fuel delivery port and a selectively openable valve element to provide communication to the engine through the port when open, and to provide when the port is closed sealable engagement at two locations spaced in the direction of flow through the port and defining between said locations a cavity, the method comprising supplying fuel and gas independently to the port at respective pressures, one of the fuel and gas being supplied to said cavity and the other being supplied upstream of both sealable engagement locations, cyclically opening the valve element to communicate said port with the engine to permit delivery of fuel entrained in gas to the engine, and regulating the pressure differential between the fuel and the gas at the cavity to control the rate of fuel flow into the gas at the cavity.

When the port is in communication with the engine, the gas establishes a pressure in the port that is less than the fuel pressure so that fuel will flow into the gas as it passes through the port. Accordingly control of the quantity of fuel delivered into the gas may be effected by varying the pressure difference between the gas pressure in the port and the fuel supply pressure. Alternatively the control of the quantity of fuel delivered may be effected by maintaining the above pressure difference steady and varying the duration of the period that the port is open.

Rapidly occuring variations of fuel demand may be accommodated by varying the period that the port is open, while more gradual variations in fuel demand are accommodated by varying the pressure difference between the fuel and gas. The varying of the pressure difference may be achieved by varying the pressure of the fuel supply and/or the pressure of the gas supply. When the fuel is liquid, it is more convenient to regulate the fuel pressure and to maintain the gas pressure substantially constant.

Conveniently the fuel supply pressure may be controlled by a regulator that is responsive to the fuel demand of the engine. The regulator may be electrically actuated under the control of a current determined electronically from sensings of a number of engine load condition parameters.

In many engines and engine applications it is desirable to vary the pattern of fuel distribution within a combustion chamber as engine operating conditions change. This is particularly so in endeavouring to achieve required fuel economy and/or exhaust emission control.

As the fuel is delivered into the gas within the port, through which the delivery to the engine is effected, it is possible to achieve control of the distribution of the fuel within the combustion area of the engine through control of the location or timing of delivery of the fuel into the gas.

The fuel may be introduced into the gas flow at the port at two or more locations. The locations may be selected so as to influence the spray pattern of the fuel as it issues from the port. Alternatively, or in addition, the timing of fuel delivery to, and/or the fuel flow rates at, each location may be controlled to different rates to also influence the spray pattern. Further the fuel flow rates at one or more locations may be variable in response to selected engine operating conditions.

In accordance with one preferred embodiment of the invention, there is provided a method of delivering fuel to an engine comprising supplying fuel and gas at respective pressures independently to a port selectively communicable with the engine combustion charge, cyclically communicating said port with the engine combustion charge to permit a flow of fuel and gas from the port into said combustion charge with the fuel entrained in the gas, and while the port is in communication with the combustion charge controlling the location and/or rate of admission of the fuel into the gas to regulate the fuel distribution pattern in the combustion charge, and regulating the pressure difference between the fuel and gas supplies and/or the period of communication between the port and combustion change in accordance with engine load to control the quantity of the fuel delivered to the engine per cycle.

It will be appreciated that fuel will only flow into the gas in the port if the fuel pressure at the port is above the gas pressure at the point of entry of fuel to the port. This differential in pressure is initially derived from regulating the respective pressures of the fuel and gas to establish a base differential in pressure, and varying the pressure of the fuel or the gas in accordance with the variations in the fuel demand of the engine to obtain the necessary variation in fuel supply. The physical arrangement of the port and the associated valve will influence the actual pressure condition in the gas stream where the fuel is introduced to the gas stream, and these will be accounted for in the calibration of the pressure regulators controlling the fuel and gas pressure.

In the regulation of the pressure of the gas and fuel, respectively, to effect the metering of the fuel, it will be appreciated that the actual pressure differential at the point where the fuel enters the gas stream is the controlling factor in the metering of the fuel. However a number of factors, particularly space constraints prevent controlled regulator devices being located in close proximity to the point of entry of the fuel into the gas in the cavity formed in the port. The distancing of the regulator devices from the point of entry of the fuel into the gas requires the flow areas of the passages carrying the fuel and gas respectively to the cavity to be adequate to ensure changes in pressure at the regulator devices are accurately reflected at the cavity. It is therefore preferable for a relatively small fixed size orifice to be provided in the fuel and gas passages in close proximity to the cavity, and the passages upstream of the orifices to be of sufficient area to minimise the pressure drop therealong. Such orifices close to the cavity in the port allow the sensitivity of the pressure changes of the gas and fuel at the regulators to achieve the required accuracy in the metering of the fuel.

Conveniently a plurality of fuel orifices may be provided to deliver fuel into the cavity at selected areas of the port to obtain a desired fuel distribution in the combustion charge. Preferably the fuel issues from a plurality of fuel orifices arranged in a circular formation about the axis of an annular gas orifice. The number and location of the fuel orifices from which fuel issues may be varied in accordance with predetermined engine operating conditions and so influence the shape of the fuel spray issuing from the port and hence control the distribution of the fuel in the engine combustion charge.

In order to achieve efficient combustion and emission control it is desirable to ensure a readily ignitable fuel-air mixture is established at the ignition point, particularly under low load engine operating conditions. The variation in the number of fuel orifices in operation may be controlled, to achieve the required fuel-air ratio at the ignition point, by directing a greater proportion of the fuel per delivery into the combustion charge adjacent the ignition point. Conveniently, under low engine load conditions all of the fuel is delivered into the combustion charge to be adjacent the ignition point at ignition.

There is also provided by the present invention an apparatus for metering fuel to an engine comprising fuel supply means and gas supply means each adapted to deliver to the same delivery port, a valve element operable to selectively open said port to communicate the port in use with an engine, said port and valve element when closed sealably engaging at two locations spaced in the direction of flow through the port and defining between said locations a cavity, at least one of the fuel supply means and gas supply means communicating with said cavity and the gas supply means communicating with the port upstream of said two sealably engaging locations, means to cyclically operate the valve element to open said port to permit delivery of fuel entrained in gas to the engine through said port, and means to regulate the pressure differential between the fuel supply and gas supply at the cavity to control the rate of fuel flow into the gas.

A number of fuel ports may be provided, each feeding fuel into the cavity. The location of the fuel ports is selected to provide the desired fuel distribution in the spray pattern of the fuel-gas mixture issuing from the delivery port. Means may be provided to selectively control the timing and/or the fuel flow rate from one or more of the fuel ports so the spray pattern may be varied in response to engine operating conditions.

Conveniently the rate of fuel supplied to the port when the port is open is controlled by means operable in response to engine load to regulate the differential between the pressure of the gas and the fuel supplied to the cavity.

A plurality of fuel orifices may be provided communicating with the cavity. The fuel orifices may be distributed along the length of the cavity to achieve the desired fuel distribution into the combustion charge as the fuel-gas mixture is delivered. The fuel orifices may be generally uniformly distributed with means provided to selectively terminate the flow through at least some of them to control the fuel distribution.

The provision of the two spaced locations of sealing engagement between the port and valve element, and the communication of the fuel and gas supplies with the port at locations separated by one of the locations of sealing engagement, enables the single valve element to control the introduction of the fuel into the gas and the delivery of the resultant fuel-gas mixture to the engine. The construction of the fuel metering apparatus is thereby simplified and control of the fuel supply rate is achieved with accuracy.

The cavity may be in an annular form provided by a peripheral groove in the sealing face of the port to form a annular seal surface on either side of the groove with the orifices entering the base of the groove. This construction results in the sealing surface of the valve element not contacting the edges of the orifices when the valve element is in the closed position. This improves sealing efficiency and the effective life of the seal between the valve element and the port.

The invention will be more readily understood from the following description of one practical arrangement of the fuel metering apparatus and method of operation thereof with reference to the accompanying drawings.

Figure 1:
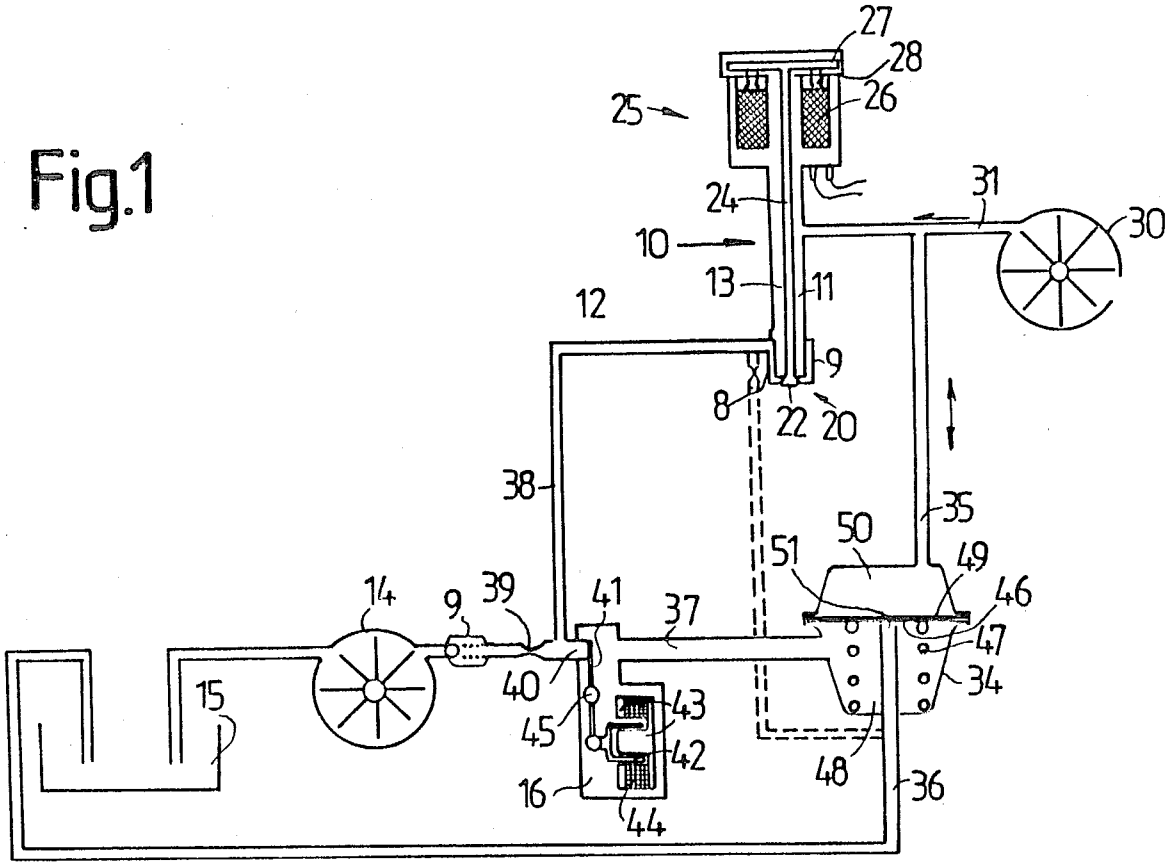
FIG. 1 is a schematic diagram of the fuel supply system embodying the present invention.

Referring now to FIG. 1 the metering apparatus 10 comprises a stem 11 with a central air passage 13 and two fuel passages 8 and 9. Communicating with the fuel passages 8 and 9 is a fuel supply conduit 12 that receives fuel from the fuel pump 14 which draws fuel from the fuel reservoir 15. The pressure of the fuel in the conduit 12 on the delivery side of the pump 14 is controlled by the fuel pressure regulator 16 and pressure regulator 34 which will be described in further detail hereinafter.

The air passage 13 has at the lower end a delivery port 20 and an operatively associated valve element 22 rigidly connected to the actuator rod 24.

The fuel passages 8 and 9 terminate in the seat surface of the port 20, as later described in detail, and are located so that when the valve element 22 is in closed relation with the port 20 the end of the fuel passages 8 and 9 are also closed by the valve element.

The solenoid type valve actuator 25 has an electromagnet coil 26, and an armature 27 which is coupled to the rod 24. The armature 27 is loaded by springs 28 in the upward direction, as seen in the drawing, so as to normally hold the valve element 22 so the port 20 is closed. Energising of the coil 26 by an electric current causes the armature 27 to move downwardly as viewed in the drawing, and hence displace the valve element 22 and open the port 20.

The air compressor 30 is connected by the conduit 31 to the air passage 13. The conduit 31 and hence the air on the delivery side of the compressor 30 is in communication with the referencing regulator 34.

The compressor 30 may have its own air pressure regulator to control the basic supply pressure relative to atmospheric conditions, but this is not essential to the function of the metering system of the present invention, and is therefore not further discussed here. Additionally the air compressor could be replaced by an alternative compressed gas source, and this may be practical where that alternative gas source is more convenient for other purposes.

The referencing pressure regulator 34 acts in a manner whereby the pressure difference between conduits 35 and 37 is maintained essentially constant. This characteristic allows the fuel pressure in conduit 37 to rise or fall to compensate for variations in the air supply pressure. This characteristic may be explained as follows. Fuel supplied by the pump 14 passes into both conduit 38 and conduit 37. In the latter case fuel passes through port 40 and past the member 41, incurring a pressure drop or not, depending on the control of fuel pressure regulator 16. The operation of this device does not impact the present explanation and will be described further in due course.

Fuel passing through conduit 37 enters chamber 48 where the pressure of the fuel on diaphragm 49 supplements the force applied thereto by a spring 47 to oppose the force created by the air pressure in chamber 50 acting on the opposite side of the diaphragm 49. When the total force on the fuel side of the diaphragm increases above that on the air side, the port 51 will open to permit fuel to flow from the chamber 48 through the return conduit 36 to the fuel reservoir 15. Any tendency for the pressure to rise in chamber 48 relative to that in chamber 50 results in further displacement of the diaphragm 49 to increase the flow path at the port 51, to prevent that increase in fuel pressure in the chamber 48.

It will be appreciated that the pressure each side of the diaphragm would become essentially equal if the spring 47 were not present. The spring loading allows an essentially fixed pressure difference to be maintained. In this case the fuel pressure is regulated to be lower than the air pressure, which determines a basic reference of the fuel supply pressure to the air supply pressure for the metering apparatus 10. This pressure relationship would be reflected at conduits 12 and 31 if no pressure drop exists across the regulator 16.

The function of the controlled regulator 16 is to modify the relative fuel and air pressure at the metering apparatus 10 by forcing a pressure difference to exist between port 40 and conduit 37. This pressure difference is reflected as an increased fuel pressure upstream of port 40 relative to the air supply pressure, given that a fixed relationship exists between conduits 37 and 35. It will be appreciated that a sufficiently high pressure difference across the controlled regulator 16 will result in the fuel pressure in conduit 12 being above the air pressure in conduit 31 and air passage 13.

The controlled regulator 16 may be configured to operate in a variety of ways. Conveniently the device is electronically controlled. In the example shown, fuel from the fuel pump 14 passes through the check valve 9 and restriction 39, which acts only to conveniently limit flow, but is not essential to the operation of the regulator 16. The fuel passes through port 40 via the spill member 41, which is controlled to vary the flow path area through port 40. Depending on the variation, a corresponding change in pressure difference between port 40 and conduit 37 is established.

Although the magnitude of this change may be affected to some degree by pressure flow characteristics of the pump 14, conveniently, the pump characteristics may be made to have little effect on the control characteristics of the regulator 16, as in the particular configuration shown.

This arises from the fact that the change in the flow path area through port 40 may be accomplished by a force equilibrium in the member 41. This equilibrium is between firstly the fluid pressure at port 40, acting over the projected area of the port, perpendicular to the member and secondly, an electro-magnetic force being created on the coil 42, again perpendicular to the member 41 about a pivot 45. This pivot is not essential to the operation of the device insofar as direct application of the electro-magnetic force may be made to a valve element associated with the port 40.

Conveniently, the electro-magnetic force is created by a permanent magnet 44, through magnetic paths 43, interacting with a current in the coil 42. A force proportional to the current in the coil is thus created which, in turn, creates a proportional pressure drop between port 40 and conduit 37. Thus, an input of electrical current in coil 42 may produce a corresponding pressure drop in proportion to the current, and essentially independent of the characteristics of the pump 14.

It will be appreciated that there are alternative ways to control the pressure differences between conduit 12 and air passage 13 communicating with conduit 31.

Further information in regard to details of construction of devices suitable for performing the function of the referencing regulator 34 and the control regulator 16 are disclosed in our International Patent Application No. PCT/AU85/00176 and corresponding U.S. patent application No. 849501, and the disclosures in the specifications of these applications are incorporated herein by reference.

With the above discussed relationship between the pressure of the fuel in the fuel passages 8 and 9 and the pressure of the air supply available in the air passage 13, the metering of the fuel is carried out in the following manner. Upon energising the coil 26 of the solenoid 25, the armature 27 moves downwardly so that the valve element 22 opens the port 20. At this stage, air flows from the air passage 13 through the delivery port 20, whilst at the same time fuel flows from the fuel passages 8 and 9 into the port 20 and is immediately entrained in the air passing through the fuel delivery port 20. There is therefore a continuing flow of fuel and air from the delivery port 20 so long as the solenoid coil 26 remains energised.

Upon the de-energising of the coil 26 the valve element 22 is immediately returned by spring loading to the closed position, seated in the port 20, terminating the supply of air and fuel from the fuel delivery port 20.

The operation of the solenoid 25 is controlled by a suitable mechanism which energises the solenoid in timed relation to the engine cycle, this timing being capable of variation in response to engine operating conditions. The period that the solenoid is energised is sufficient for the fuel delivered from the delivery port 20 to meet the engine demand at that time.

The regulation of the amount of fuel supplied may be achieved by either varying the time for which the solenoid is energised, or by energising the solenoid for a fixed period each time but varying the number of periods that the solenoid is energised for each cycle of the engine In addition to the control that may be obtained by the varying of the period or number of cycles of the solenoid it is also possible, as previously discussed, to vary quantities of fuel delivered to the engine by controlling the pressure of the fuel relative to the pressure of the air. Also it is possible for both these controls to be operated so that the combined effect produces the required quantities of fuel to be delivered to the engine.

Suitably controlling processes may be set up to regulate the energising of the solenoid 25 and the operation of the regulator 16 in accordance with the various known programmes of sensing a range of engine conditions and processing these to produce electric signals appropriate to operate a solenoid or like device for regulation of the amount of fuel delivered to an engine.

Figure 2:
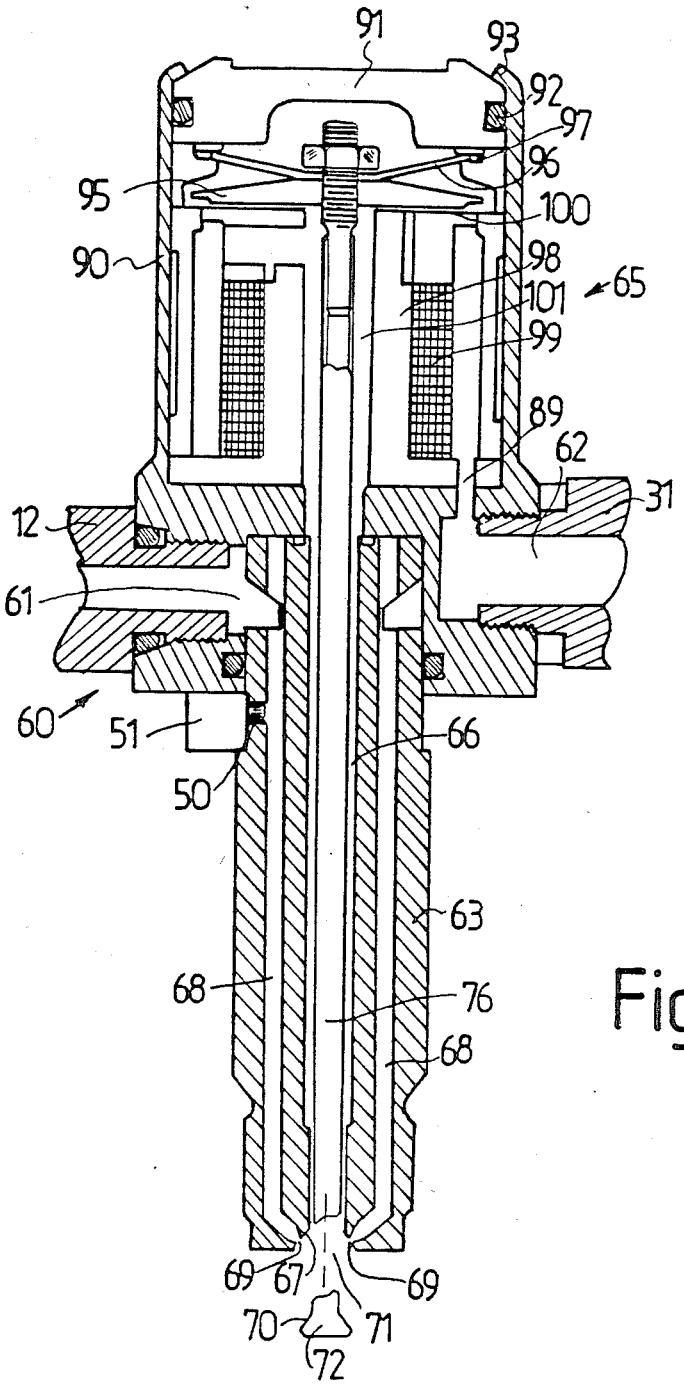
FIG. 2 is a sectional, partly exploded, view of the metering unit.

Referring now to FIG. 2 of the drawings, which illustrates in more detail a metering unit 10 comprising a body 60 and a solenoid unit 65. The body 60 has a fuel inlet port 61 to which the fuel supply line 12 is connected and an air inlet port 62 to which the air supply line 31 is connected.

The body 60 has a stem portion 63 with a central axial chamber 66 extending axially therethrough. The axial chamber 66 communicates, as later described, at the upper end with the air inlet port 62, and at the lower end has a delivery port 71 with which the delivery valve 72 co-operates. The delivery valve 72 is rigidly attached to the actuator rod 76 which extends from the solenoid unit 65 through the axial chamber 66.

The fuel inlet port 61 communicates with the two fuel passages 68 provided in the stem portion 63 on either side of the axial chamber 66. The fuel passages 68 terminate in ports 69 provided in the sealing face 67 of the delivery port 71. As seen in more detail in FIG. 3, the fuel passages 68 each incorporate a restricting orifice 90 at the port 69. The bore of the orifices 90, relative to passages 68 and the other fuel passages leading from the fuel pressure regulator, are such that the regulator and the orifices determine the pressure of the fuel issuing from the orifices. The downstream end of each orifice 90 opens into an annular cavity 91 formed in the sealing face 67 of the delivery port 71. The sealing face 67 is thus divided into two annular seal surfaces **67*a* and 67*b***.

Figure 3:
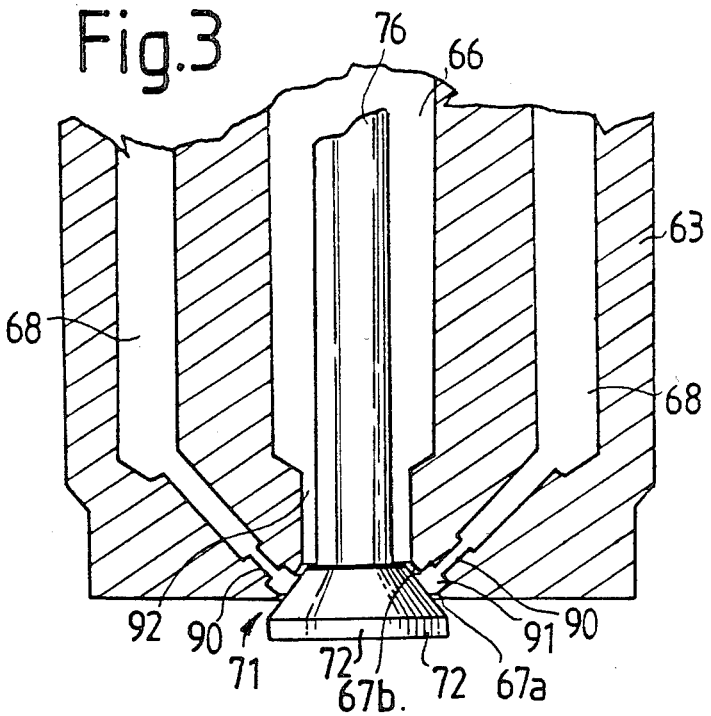
FIG. 3 is an enlarged sectional view of the delivery port and valve portion of the metering unit shown in FIG. 2.

In the preferred embodiment, as shown in FIG. 3, the minimum flow path areas presented to a gas flow from central chamber 66 are formed in the respective annular restrictions created between the sealing surfaces **87*a* and 87*b* in relation to the valve member 72, with its particular open position. The ratio of the annular areas, as well as the ratio of the air pressure supply provided to the annular cavity 66 relative to the pressure existing downstream of the port 71, determines an air pressure in the annular cavity 91. The air pressure is regulated to establish in the cavity 91, when the valve 72 is open, a pressure below the fuel pressure, as previously described, and so the fuel flow rate through port 71 when the valve 72 is open is determined by the difference in these pressures at the cavity 91**.

The provision of accurately specified restrictions in the fuel and air passages adjacent to the port 71 provides improved accuracy in the control of the pressure differential and hence the fuel delivery rate. Further, the provision of restrictions between sealing faces **87*a* and 87*b* and the valve member 72, created by the limited extent of movement of the valve member 72, has the further advantage that the pressure developed in cavity 91 as the gas flows through is not strongly affected by variations in the degree of opening of the valve which may arise due to undesirable variations in the degree of movement, or stroke, provided by the solenoid actuation assembly connected to the valve member 72**.

It will be appreciated that the above-described construction provides that downward movement of the actuator rod 76 will displace the delivery valve 72 relative to port 71 and thereby open the valve so that sealing face 70 of the valve element 72 is displaced from both seal surfaces **67*a* and 67*b*. The port 71 is thereby opened so that the air enters past sealing surface 67*a* and leaves past sealing surface 67*b* establishing a pressure in the cavity 91 a pressure which depends on the ratio of the areas of restrictions produced by the sealing surfaces 67*a* and 67*b* in spaced relationship to valve 72. Fuel enters the cavity to be entrained with the air and is hence delivered to the engine as a fuel-air mixture. The pressure differential between the air in the cavity 91 and the fuel entering the cavity through the orifices 90 determines the rate of fuel entry into the air stream and hence the rate of fuel supply to the engine. Accordingly, variation of this pressure difference is one factor in controlling the fuel demand. The orifices 90 and the restriction provided by sealing surfaces 67*a*, 67*b* and valve 72 have respective fixed calibrations and, in combination with the regulation of the pressure difference between the fuel in the passages 68 and the air in the axial passage 66** as previously described, provide an effective manner of metering the fuel to an engine to meet the fuel demand thereof.

The preferred embodiment, as stated above, incorporates two restrictions defined by surfaces **67*a* and 67*b* in spatial relationship to valve 72. This has the advantage that variations in the degree of opening of the valve do not strongly affect the pressure in cavity 91, due to the fact that the pressure is more strongly related to the ratio of the respective areas of restriction rather than the magnitude of each area of restriction. It may be appreciated that the area of restriction of each varies in direct proportion to the degree of opening of the valve 72 and thus the ratio of areas remains essentially constant, in turn, resulting in a relatively constant pressure in cavity 91**.

Figure 4:
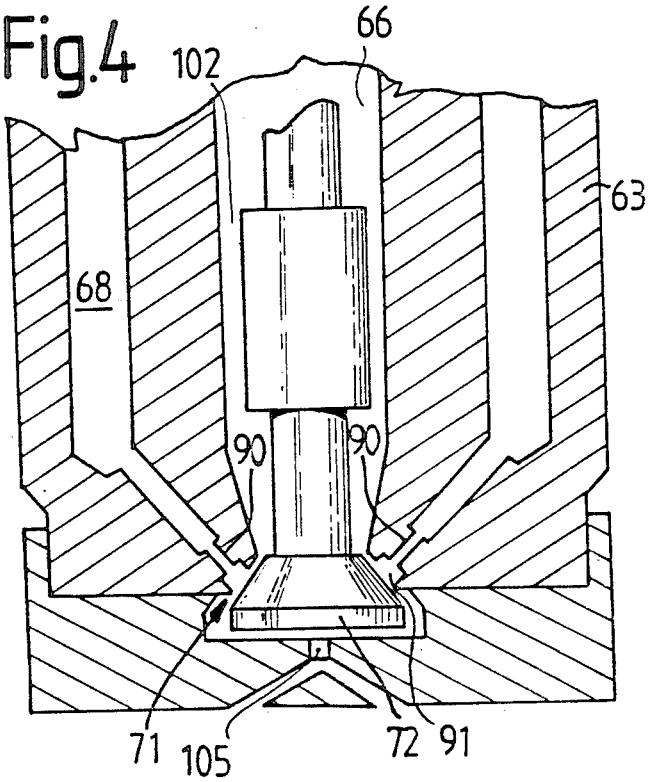
FIG. 4 is a view similar to FIG. 3 of a modified port and valve.

Notwithstanding this, it has been found useful in some applications of the injection system to provide a flow directive nozzle beyond the port 71 in a downstream direction to allow more directive flow trajectories for the issuing fuel spray. With this modification, as shown in FIG. 4, it is convenient to provide a fixed restrictive orifice 102 upstream of the port 71, which is a complement to the fixed restriction of the directive nozzle 105. The ratio of the fixed restrictions 102 and 105 largely determines the pressure in the cavity 91 for a given air supply pressure in the annular space 66, of FIG. 4. In this case, the restrictions formed by the sealing surfaces **67*a* and 67*b* as referred to above, each side of cavity 91** also affect the pressure to a much smaller degree than previously.

As previously discussed where two or more fuel ports 69 are provided, the fuel spray pattern and hence the fuel distribution in the engine combustion chamber may be varied by regulating the fuel flow rate through each port. As shown in FIG. 2 this may be achieved by providing a restrictor member 50 actuated by a fluid pressure or electric motor 51 that may be selectively projected into the fuel passage 68 to restrict the flow therethrough. The motor may be controlled by a processor in response to engine load conditions to provide the required degree of flow restriction or complete flow termination. Although only two fuel ports are shown in FIGS. 1, 2 and 3 it is preferable to provide at least three, and more may be provided if desired. Separate passages such as 68 may be provided for each port or several ports may be fed from a single fuel passage.

The solenoid unit 65 is housed within the cylindrical wall 90 forming part of the body 60 which is sealed at the upper end by the cap 91 and O-ring 92, held captive by the swaged margin 93 of the wall 90. The solenoid unit is thus within an enclosure through which the air may pass from the air inlet port 62 via the opening 89 to provide air cooling of the solenoid unit.

The solenoid armature 95 is rigidly attached to the upper end of the actuator rod 76. The disc spring 96 is attached at the centre to the actuator rod 76, with the marginal edge of the disc captive in the annular groove 97. The disc spring 96 in its normal state is stressed to apply an upwardly directed force to the actuator rod 76 to hold the valve 72 in the closed position. The electric coil 99 is located about the core 98 and wound to produce a field when energised, to draw the armature 95 downward. The downward movement of the armature will effect a corresponding movement of the actuator rod 76 to open the fuel ports 69 and delivery port 71. Upon de-energising of the coil 99, the spring 96 will raise the actuator rod 76 to close the ports 69 and 71. The degree of downward movement of the armature 95 is limited by the armature engaging the annular shoulder 100.

The core 98 of the solenoid unit has a central bore 101 which is in communication with the central axial chamber 66. The air entering the air port 62 will thus flow through the solenoid unit to enter the bore 101 and hence pass to the chamber 66 and through the delivery port 71 when the port is open. The flow of air through the solenoid unit provides cooling to assist in maintaining the temperature thereof within an acceptable level.

The claims defining the invention are as follows:

1. A method of metering fuel to an engine having a fuel delivery port and a selectively openable valve element to provide communication to the engine through the port when open, and to provide when the port is closed, sealable engagement at two locations spaced in the direction of flow through the port and defining between said locations a cavity, the method comprising supplying fuel and gas independently to the port at respective pressures, one of the fuel and gas being supplied to said cavity and the other being supplied upstream of both sealable engagement locations, cyclicly opening the valve element to communicate said port with the engine to permit delivery of fuel entrained in gas to the engine, and regulating the pressure differential between the fuel and the gas at the cavity to control the rate of fuel flow into the gas at the cavity.

2. A method as claimed in claim 1 wherein the pressure differential is regulated in accordance to the engine load.

3. A method as claimed in claim 1 or 2 wherein the period of communication between the port and the engine is regulated in accordance with engine load.

4. A method as claimed in claim 1 or 2 wherein the fuel is supplied to the cavity.

5. A method as claimed in claim 1 or 2 wherein the fuel is supplied to the cavity at a plurality of locations spaced along the cavity length.

6. A method as claimed in claim 5 wherein, during operation of the engine, the number of said locations at which fuel is supplied is varied to control the distribution of the fuel as delivered to the engine.

7. A method as claimed in claim 5 where the rate of fuel supplied to the cavity at at least some of the location is varied to control the distribution of the fuel as delivered to the engine.

8. Apparatus for metering fuel to an engine comprising fuel supply means and gas supply means each adapted to deliver to the same delivery port, a valve element operable to selectively open said port to communicate the port in use with an engine, said port and valve element when closed sealably engaging at two locations spaced in the direction of flow through the port and defining between said locations a cavity, one of the fuel supply means and gas supply means communicating with said cavity and the other of the fuel supply means and gas supply means communicating with the port upstream of said two sealably engaging locations, means to cyclically operate the valve element to open said port to permit delivery of fuel entrained in gas to the engine through said port, and means to regulate the pressure differential between the fuel supply and gas supply at the cavity to control the rate of fuel flow into the gas.

9. Apparatus as claimed in claim 8 wherein the fuel supply means communicates with the cavity.

10. Apparatus as claimed in claim 8 wherein the fuel supply means communicates with the cavity through a plurality of apertures spaced along the periphery of the cavity.

11. Apparatus as claimed in claim 10 wherein means are provided to vary the number of said apertures providing communication between the fuel supply means and the cavity

12. Apparatus as claimed in claim 10 or 11 wherein means are provided to vary the fuel flow rate through at least some of said apertures.

13. Apparatus as claimed in claim 11 wherein said means to vary the number of apertures in communication with the fuel supply means is operable in response to engine operating conditions.

14. Apparatus as claimed in claims 8 to 10 or 13 wherein the means to regulate the pressure differential between the fuel supply and gas supply at the cavity are operable in response to engine fuel demand.

15. Apparatus as claimed in claim 8 to 10 or 13 wherein the means to regulate the pressure differential is adapted to regulate the fuel pressure in response to the engine fuel demand.

16. Apparatus as claimed in claims 8 to 10 or 13 wherein the port has two coaxial annular sealing faces spaced in the direction of opening movement of the valve element, said valve element being adapted to sealably engage said faces when in the closed position, said cavity being an annular groove in the port coaxial with and located between the annular sealing faces.

17. Apparatus as claimed in any one of claims 8 to 10 or 13, wherein the port has two co-axial annular sealing faces spaced in the direction of opening movement of the valve element, said valve element being adapted to sealably engage said faces when in the closed position, said cavity being an annular groove in the port co-axial with and located between the annular sealing faces, and the port has a truncated conical or spherical internal surface on which sealing faces are provided.

18. Apparatus as claimed in any one of claims 8 to 10 or 13, wherein the port has two co-axial annular sealing faces spaced in the direction of opening movement of the valve element, said valve element being adapted to sealably engage said faces when in the closed position, said cavity being an annular groove in the port co-axial with and located between the annular sealing faces, and an annular orifice is provided co-axial with and upstream of the annular sealing faces.

19. Apparatus as claimed in any one of claims 8 to 10 or 13, wherein the port has two co-axial annular sealing faces spaced in the direction of opening movement of the valve element, said valve element being adapted to sealably engage said faces when in the closed position, said cavity being an annular groove in the port co-axial with and located between the annular sealing faces, and an orifice is provided downstream of the annular sealing faces.

20. A method of delivering fuel to an engine comprising supplying fuel and gas at respective pressures independently to a port selectively communicable with the engine combustion charge, cyclically communicating said port with the engine combustion charge to permit a flow of fuel and gas from the port into said combustion charge with the fuel entrained in the gas and while the port is in communication with the combustion charge controlling the location of admission of the fuel into the gas to regulate the fuel distribution pattern in the combustion charge, and regulating the pressure difference between the fuel and gas supplies in accordance with engine load to control the quantity of the fuel delivered to the engine per cycle.

21. A method as claimed in claim 20 wherein the fuel is deliverable to the port at a plurality of spaced locations, and the number of locations at which fuel is delivered is varied in accordance with the required fuel distribution pattern.

22. A method as claimed in claim 20 wherein the rate of delivery of fuel at at least some of the locations is varied in accordance with the required fuel distribution pattern.

23. A method as claimed in any one of claims 20 to 22 where the period that communication exists between the port and combustion charge is controlled to control the quantity of fuel delivered to the engine per cycle.

24. Apparatus for delivering fuel to an engine comprising fuel supply means and gas supply means each adapted to deliver to a selectively openable delivery port, means to cyclically open said port to communicate with an engine combustion charge to permit a flow of fuel and gas into the combustion charge, means to control the location of admission of fuel into the gas while the port is open to regulate the fuel distribution pattern in the combustion charge, and means to regulate the pressure difference between the fuel and gas supplies at the port in accordance to engine fuel demand to control the quantity of fuel delivered to the engine.

25. Apparatus as claimed in claim 24 wherein the fuel supply means is adapted to supply fuel to a plurality of locations for admission to the port, and the means to control the location of fuel admission is adapted to vary the locations at which fuel is admitted in accordance with the required fuel distribution pattern.

26. Apparatus as claimed in claim 24 wherein means are provided to vary the rate of fuel delivery at at least some of said locations in accordance with the required fuel distribution pattern.

27. Apparatus as claimed in any one of claims 24 or 25 wherein means are provided to vary the period per engine cycle that the port is in communication with the combustion charge.

28. A method as claimed in any one of claims 1, 2, 20 21 or 22 wherein the port delivers the fuel-gas mixture directly into a combustion chamber of the engine.

29. Apparatus as claimed in any one of claims 8 to 10, 13, 22 or 24 wherein the port is adapted to deliver the fuel-gas mixture directly into an engine combustion chamber.

30. An internal combustion engine including means to deliver fuel thereto, said means being adapted to operate in accordance with the method as claimed in any one of claims 1, 2, 20, 21 or 22.

31. In an automotive vehicle an internal combustion engine including means to deliver fuel thereto, said means being adapted to operate in accordance with the method as claimed in any one of claims 1, 2, 20, 21 or 22.

32. An outboard marine engine including means to deliver fuel thereto said means being adapted to operate in accordance with the method as claimed in any one of claims 1, 2, 20, 21 or 22.

33. An internal combustion engine including apparatus to deliver fuel thereto as claimed in any one of claims 8 to 10, 13, 22, 24, 25 or 26.

34. In an automotive vehicle and internal combustion engine including apparatus to deliver fuel thereto as claimed in any one of claims 8, to 10, 13, 22, 24, 25 or 26.

35. An outboard marine engine including apparatus to deliver fuel thereto as claimed- in any one of claims 8 to 10, 13, 22, 24, 25 or 26.

36. A method of metering fuel to an engine having a fuel delivery port and a selectively openable valve element associated with the port and when open providing communication to the engine through the port and when closed providing sealable engagement at two locations spaced in the direction of flow through the port, said two locations defining a cavity therebetween, said method comprising supplying fuel and gas at respective pressures independently to the port with one of the fuel and gas being supplied to said cavity and the other being supplied upstream of the two sealable engagement locations, cyclically opening the valve element to communicate the port with the engine to deliver fuel entrained in gas to the engine, and controlling the rate of fuel flow into the gas at the cavity by regulating the pressure differential between the fuel and the gas at the cavity.

37. A method of delivering fuel to an engine comprising supplying fuel and gas at respective pressures to a port selectively communicable with the engine, cyclically communicating the port with the engine to deliver a flow of fuel entrained in gas from the port to the engine, regulating the fuel distribution pattern in an engine combustion charge by controlling the location of admission of the fuel into the gas, and controlling the quantity of fuel delivered to the engine per cycle by regulating the pressure differential between the fuel and gas supplied to the port.

38. Apparatus for metering fuel to an engine comprising fuel supply means for delivery fuel at a first pressure to a delivery port, gas supply means for delivering gas at a second pressure to the delivery port, valve means for selectively opening the port to in use communicate in a direction of flow the port with the engine, said port and said valve means when closed sealably engaging at two locations spaced in the direction of flow and defining a cavity therebetween, one of the fuel supply means and the gas supply means communicating with the cavity and the other of the fuel supply means and the gas supply means communicating with the port upstream of the two sealable engaging locations, operating means for cyclically operating the valve means to open the port to deliver fuel entrained in gas to the engine through the port, and control means for controlling the quantity of fuel delivered to the engine per cycle by regulating the pressure differential between the fuel supply means and the gas supply means at the cavity.

39. Apparatus for delivering fuel to an engine fuel supply means for delivering fuel at a first pressure to a selectively openable delivery port, gas supply means for delivering gas at a second pressure to the port, opening means for cyclically opening the port to communicate the port with an engine combustion charge to deliver a flow of fuel and gas to the combustion charge, pattern means for regulating the fuel distribution pattern in the combustion charge by controlling the location of admission of fuel into the gas while the port is open, and control means for controlling the quantity of fuel delivered to the engine by regulating the pressure difference between the fuel and gas supplies at the port in accordance to engine fuel demand.

* * * * *